US005906554A

United States Patent [19]

Oswald

[11] Patent Number: 5,906,554

[45] Date of Patent: May 25, 1999

[54] MULTI-ZONE BASKETBALL GAME

[75] Inventor: Henry J. Oswald, Charlottesville, Va.

[73] Assignee: Off The Boards Basketball Inc., Newport News, Va.

[21] Appl. No.: 09/028,333

[22] Filed: Feb. 24, 1998

Related U.S. Application Data

[63] Continuation of application No. 08/425,150, Apr. 19, 1995, Pat. No. 5,720,485.

[51] Int. Cl.[6] ..... A63B 63/08

[52] U.S. Cl. ..... 473/472; 473/479

[58] Field of Search ..... 473/472, 479; 273/402

[56] References Cited

U.S. PATENT DOCUMENTS 5,720,485 2/1998 Oswald ..... 273/402

*Primary Examiner*—William H. Grieb
*Attorney, Agent, or Firm*—Sheldon H. Parker

[57] ABSTRACT

A basketball game area for recreation consisting of multiple zones, each having at least one hoop and backboard combination, multiple shooting indicators, and obstacles which can be free standing, and/or affixed to the hoop or backboard. The location of the obstacle in relation to the indicator changes the trajectory required to shoot the ball into the hoop. The placement of each indicator increases the difficulty in placing the ball through the hoop. The game rules provide the order of proceeding through the courts and proceeding through the sequential shooting indicators within each of the courts. The first player proceeds to the first courts, attempting to shoot the ball through the hoop, avoiding the obstacle, scoring points for placing the ball through the hoop. The players continue shooting one at a time until all players have taken a shot at the first basket from each of the indicators and then continue to proceed through the courts.

4 Claims, 5 Drawing Sheets

MULTI-ZONE BASKETBALL GAME

This is a continuation of application Ser. No. 08/425,150 filed on Apr. 19, 1995, now U.S. Pat. No. 5,720,485.

BACKGROUND OF THE INVENTION

1. Field of the Invention

The disclosed basketball game utilizes multiple courts, or zones, each with an obstacle and defined shooting areas.

2. Brief Description of the Prior Art

Basketball has been a dominate sport in the world for many years. On all levels, basketball, like all competitive activities, requires repetitive practice at shooting baskets. The repetitive process of shooting baskets can, however, require more perseverance than many people have. Due to the popularity of the game and the advantages of making "practice" more enjoyable, a variety of games have been established at many amusement areas, and the like.

The game of basketball normally includes a basket hoop and net arrangement mounted on a backboard through which a leather ball is thrown for the purpose of scoring points. The ball may be thrown directly through the basket hoop or, in the alternative, may be banked off the backboard in such a way as to cause it to go through the basket hoop. The backboard is usually flat and vertically disposed and large enough to allow bank shots from a variety of different directions. Unfortunately, this orientation of vertical backboard and horizontal hoop only permits a limited number of different bank shots to be made. When the backboard and hoop is utilized in a game in which opponents attempt to block shots, the variation of bank shots available is large enough to provide sufficient challenge. However, when a game involving just shot making is played, the limitations on the variety of available shots become severely obvious.

U.S. Pat. No. 4,036,494 discloses a backboard having a flat central panel and two flat wing panels affixed by hinges to the sides. The variation in bank shots which may be made utilizing this backboard is limited due to the limited portions which may be changed or repositioned. To increase the variety of bank shots available U.S. Pat. No. 4,239,214 discloses a basketball game which includes multiple stations, each of which has a basket hoop and a backboard which is arranged differently with respect to the hoop for presenting a different variety of bank shots to be made at each station. The '214 patent however, only relates to bank shots and does not provide the ability to practice shooting around obstacles.

U.S. Pat. No. 4,202,543 discloses a game providing a different challenge at each court by changing the size or shape of the goal, shooting stance required of the participant and incorporating motion to the goal. Fixed and moving barriers are also incorporated to provide additional difficulty.

Many other design and utility patents have issued on non-court basketball games wherein the ball is retained in a confined area by a net.

SUMMARY OF THE INVENTION

A basketball game area for recreation having at least one playing zone, each of which has at least one hoop and backboard combination, multiple shooting indicators, and obstacles. The obstacles are used to obstruct clear entry of the ball into the hoop. The obstacles can be removably and/or movably affixed to the hoop or the backboard. Alternatively, obstacles can be affixed to both the hoop and backboard or a free standing pole. One of the hoop and backboard combinations has a height less than the other hoop and backboard combinations. The indicators are placed so that a line drawn between the center of the hoop and the center of at least one of the indicators is not parallel to a line drawn between the center of the hoop and the center of at least one other indicator. The location of the obstacle in relation to each of the indicators changes the trajectory required to shoot the ball into the hoop. As a line extending from the center of the hoop, through a point in the obstacle, intersects at least one indicator, but less than all of the multiple of indicators, the obstacles provide a different type of hindrance for at least two of the indicators due to their different positions. Preferably the placement of each of the indicators in relation to the hoop increases the difficulty in placing the ball through the hoop. The difficulty in placing the ball through the hoop from each indicator should be indicated by a predetermined method of sequential identification, such as colors, numbers or letters. The colored indicators can be geometric shapes or foot prints.

The players are provided with a set of game rules, which provide the order of proceeding through the playing zones and the order of proceeding through the differentiated, sequential indicators within each of the zones. The first of the players proceeds to the first zone, and stands on the first indicator. The player shoots a ball through the hoop, being mindful of the obstacle, to score points for placing the ball through the hoop. The players continue shooting one at a time until all players have taken a shot at the first basket from each of the indicators. The players continue to proceed through the zones, until all zones have been played.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
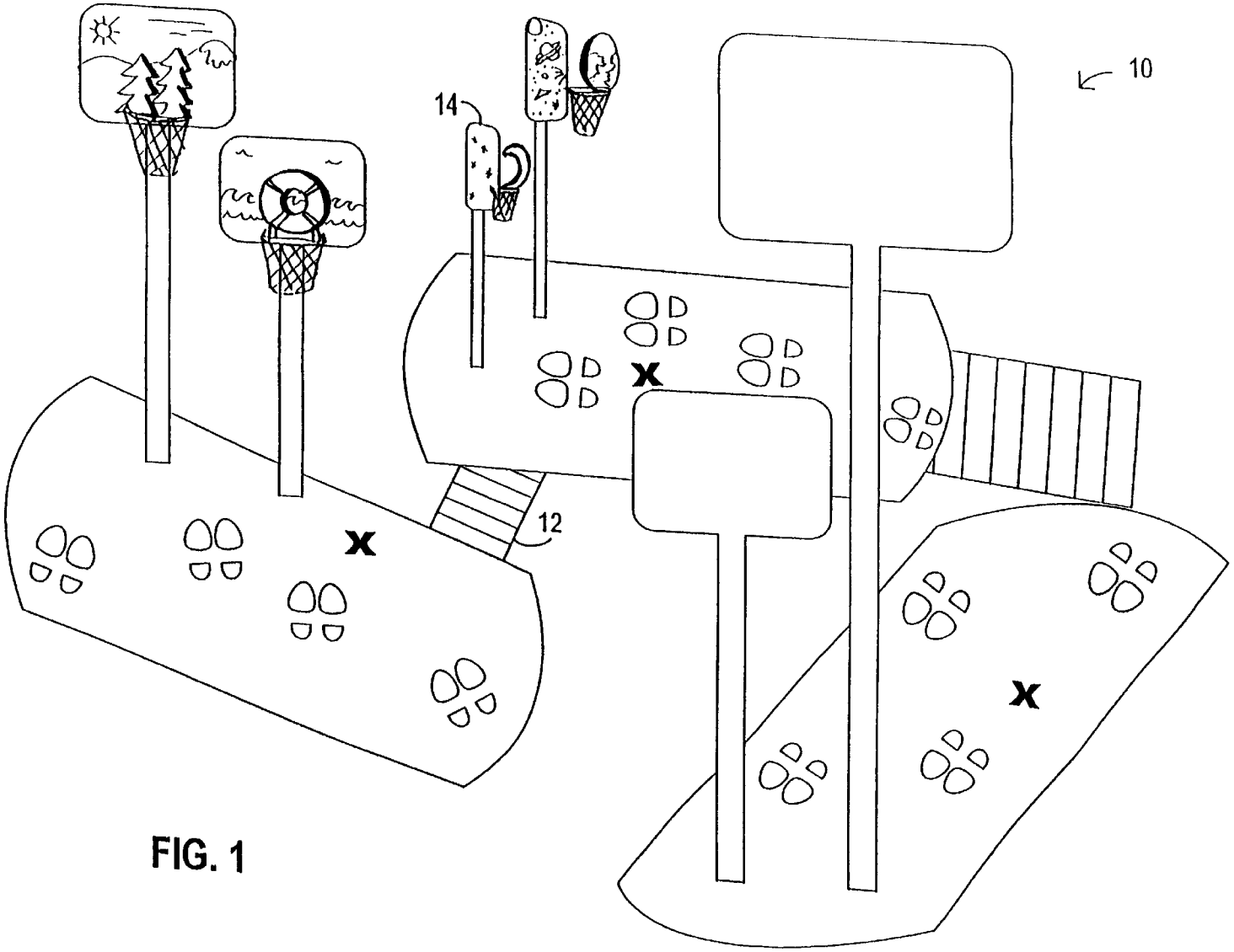
FIG. 1 is a perspective plan view of a portion of a sample game area.

The instant invention provides a stimulating basketball game which, while improving shooting ability, still retains the enjoyment of a game. The game area consists of a least one, and preferably multiple, playing zones or courts, each with multiple shooting indicators and a basket with an obstacle. In order to make the game area an activity for all ages and/or heights, each zone is preferably also provided with a lower basket and obstacle. A portion of a game area 10 is illustrated in FIG. 1, showing an example of the type of obstacles and layout of the multiple zones. This is used as an example only and in no way limits the game area to the zone arrangement or obstacles illustrated in this Figure. The zones are connected with walkways 12 which allow easy access from zone to zone. The lower baskets 14 will allow for a beginner in basketball to succeed in shooting. Backboards can be cut in the shape of animals, cars, planes, etc. making the area more colorful.

Figure 2:
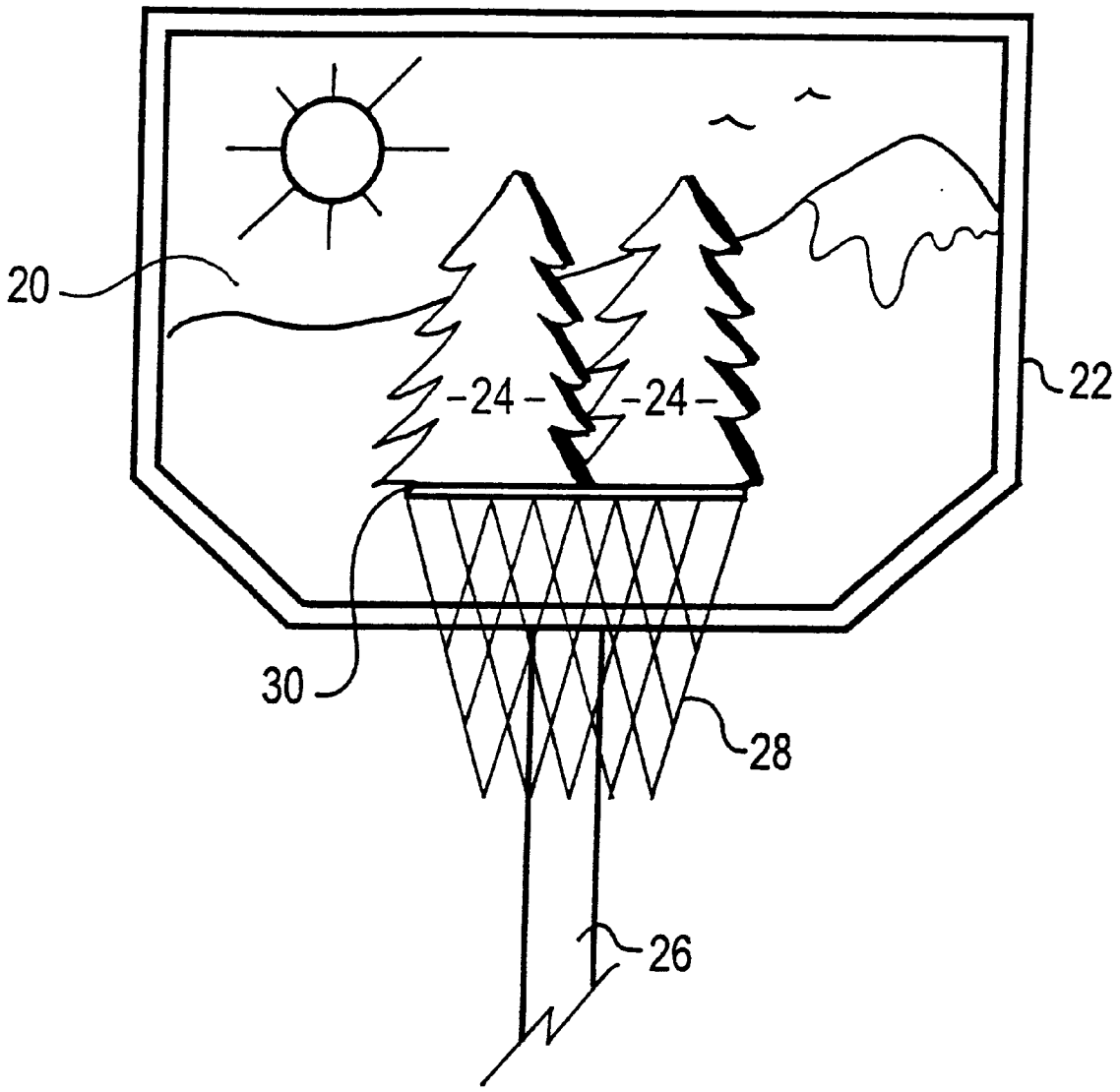
FIG. 2 is a front view of one basket for use in the instant game.
Figure 3:
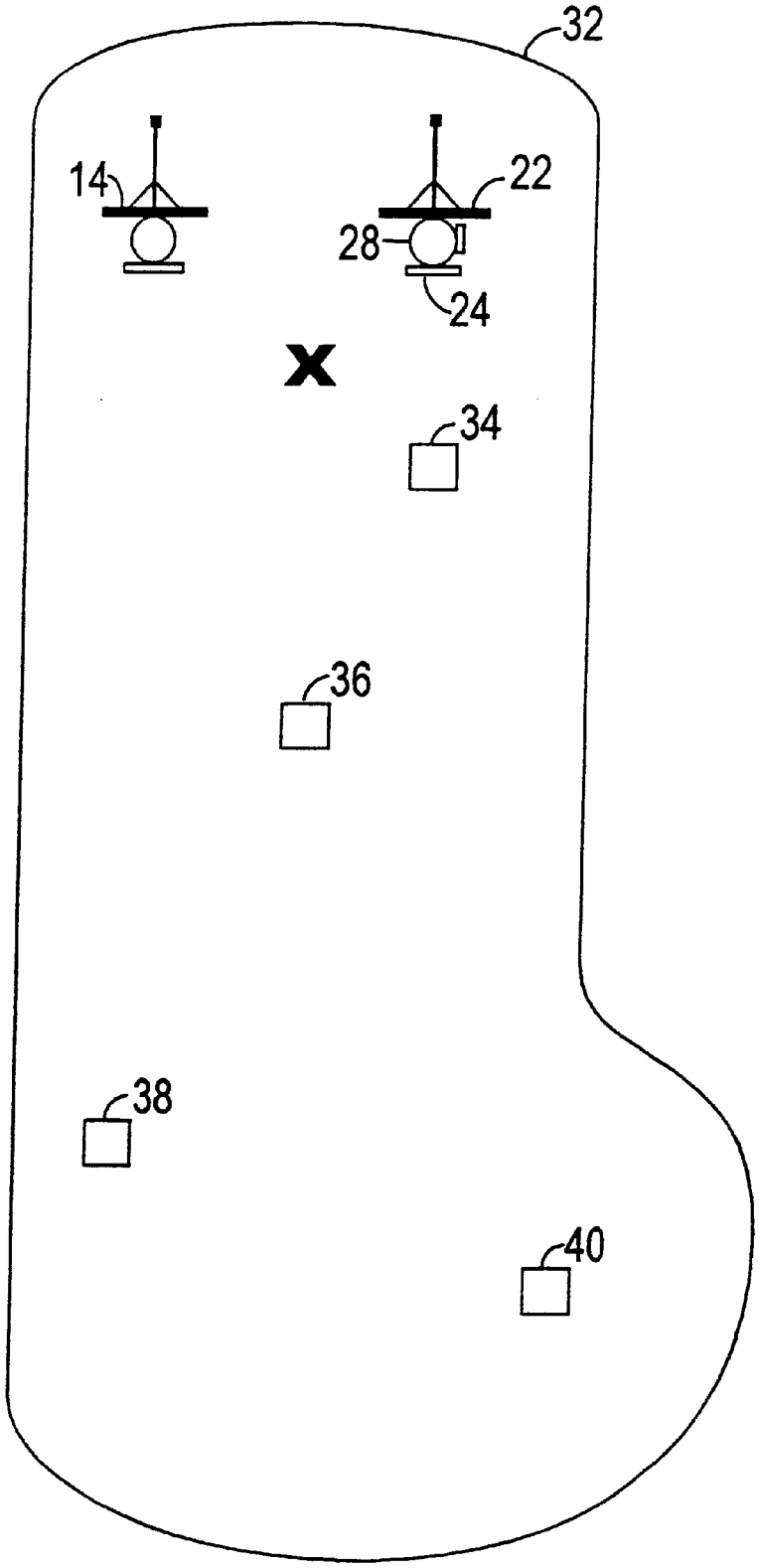
FIG. 3 is a top view of one playing zone for use with the instant game.

A more detailed example of a single basket and zone is illustrated in FIGS. 2 and 3. Each basket can use either a standard backboard 22 or a customized backboard in the shape of an animal, tree, etc. The backboard 22 can be supported through use of a wall, a metal or wood pole 26, or other means commonly known in the art. The hoop 30 and net 28 are attached to the backboard 22 through use of a standard basketball hoop bracket. The obstacle 24 is preferably positioned along the rim of the hoop 30 and must be securely affixed to prevent the obstacle 24 from moving when hit with the ball. The obstacle 24 illustrated in FIG. 2 is a pair of trees, however the obstacle 24 can be of any design desired and themes are easily incorporated. In the preferred embodiment, illustrated in more detail in FIG. 7, the backboard 90 comprises multiple layers with the backboard design 20 secured between a clear layer 92 and the supporting board 96. The backboard 22 can also be directly painted or imprinted with the design to correspond with, or compliment, the obstacle 24. It is preferable that obstacle 24 be removable from the hoop 30 to allow for the obstacle 24 to be moved or changed. This prevents the game from becoming too predictable after repeated games.

Each zone is provided with at least two shooting sequential indicators, such as circles, numbers or foot prints, with the number of indicators per zone either varying or remaining the same. The number of indicators is generally dependent upon the amount of land available, the number of zones, etc. The more indicators per zone and the more zones, the longer the game takes to complete. The zone 32, illustrated in FIG. 3, utilizes four shooting indicators 34, 36, 38, and 40. The sequential indicators 34, 36, 38 and 40, shown herein as numbered squares, are each positioned within the zone to provide a different angle of hindrance in relation to the obstacle. Therefore, if lines drawn from the center of the hoop to the center of each of the indicators, none of the lines would be parallel. The shooting indicators 34, 36, 38 and 40 are placed within the zone in a manner to provide varied difficulty in getting the ball into the basket. The difficulty level can become increasingly more difficult, easier or be varied randomly.

Figure 4:
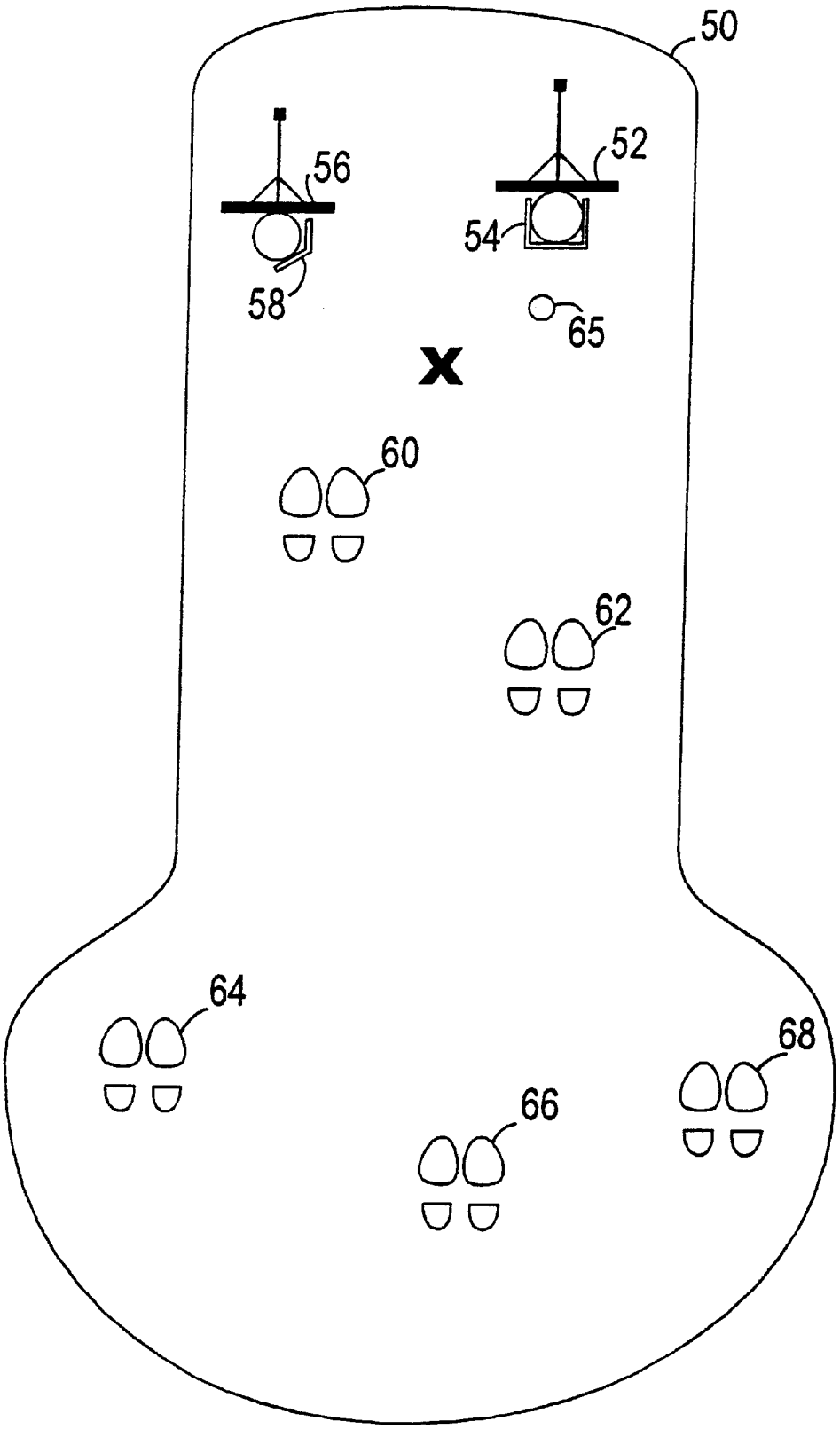
FIG. 4 is a top view of an additional playing zone for use with the instant game.

FIG. 4 illustrates an alternate zone arrangement, wherein zone 50 is provided with six pairs of footprints 60, 62, 64, 66 and 68. The basket 52 has been provided with an obstacle 54 which spans all three sides of the hoop. The configuration of the obstacle 54 can be, as stated heretofore, any design which compliments and/or coordinates with the overall area design. A two sided obstacle 58 is incorporated with the basket 56 to illustrate another variation in the obstacle and basket placement. The zone 50 illustrates a possible alternate zone design. The area of the standard rectangular court, or square half court, is increased with an oval area opposite the baskets to accommodate the additional shooting indicators 64 and 68. A free standing obstacle 65 is shown placed in front of indicators 60, 62, 64, 66 and 68. The free standing obstacle 65 can take many forms, as well as be used alone or with hoop obstacles. The free standing obstacle 65 can be designed to compliment the theme, a simple pole, or other means for blocking a clear shot to the basket. Other configurations of zones, or courts, can be utilized, incorporating L-shapes, triangles, or any other shape which allows the ability to access the basket with the ball.

Figure 5:
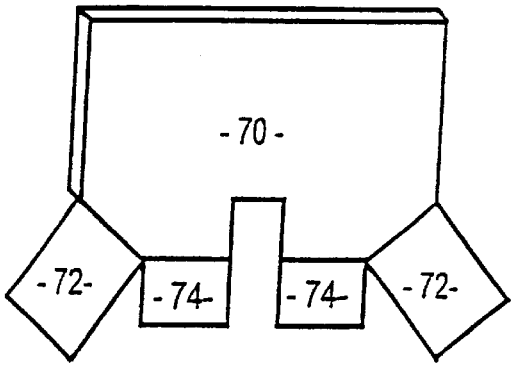
FIG. 5 is a perspective view of a backboard cover for the instant game.

The backboard 22 can also be covered with a cover, an example of which is illustrated in FIG. 5. The flexible cover 70 is dimensioned to slide over the top of the backboard 22, securely covering the front and back. The angle flaps 72 and bottom flaps 74 are removably affixed to the back of the flexible cover 70 through use of loop and hook, or other suitable fasteners. The ability to change the backboard 22 design as well as the obstacles 24 allows the game area to be redecorated to correspond to holidays or desired themes.

Figure 6:
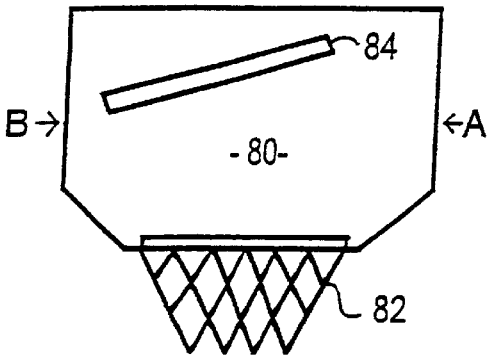
FIG. 6 is a front view of an additional basket for use with the instant game.

In another embodiment, the backboard 80 of FIG. 6 is provided with an obstacle 84 to obstruct the players' availability to the basket. The obstacle 84, illustrated herein as an example, allows for easy access when the shot is made from side A of the board. A shot taken from the center of the zone directly facing the hoop would have an increased degree of difficulty. The shot taken from side B of the board has a much greater degree of difficulty in that the ball must be thrown to fit between the hoop 82 and the obstacle 84. In U.S. Pat. No. 4,202,543 Collins discloses basketball obstacles, most of which are moving. One of his embodiments, however does incorporate a stationary obstacle to cause the player to shoot a certain type of shot. The Collins patent does not provide the increasing difficulty factor provided by the instant invention through use of the shooting indicator. The freedom to move to any location on the zone allows the players to move to their best positions to shoot rather than having to progressively increase their expertise.

Figure 7:
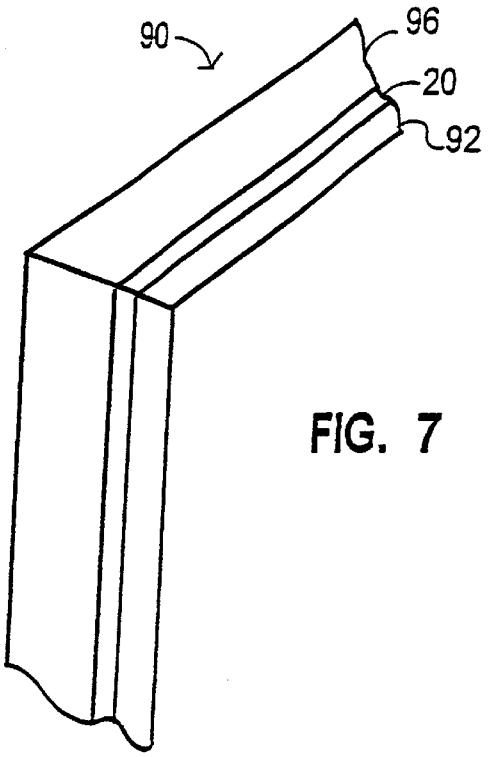
FIG. 7 is a side perspective view of the multiple layer backboard for use with the instant game.

FIG. 7 more clearly illustrates the multiple layer backboard 90 of the instant invention. A clear protective layer 92 is placed over the illustration 20 and secured to the supporting board 96. Preferably the protective layer 92 is removable from the supporting board 96 to allow for easy illustration changes. Preferably the clear protective layer is a shatterproof, semi-rigid plastic, such as Plexiglas®, to prevent warping of the illustration 20. The edge of the backboard 90 can be waterproofed through means well known in the art.

The courts are preferably marked to indicate the sequence of play. A score card and pencil, similar to those used in miniature golf, are provided to each group for tabulating scores. The score card can be printed with scoring information, sequence of indicators, rules, etc. It is preferable that each degree of difficulty increases the number of points received for a basket.

To play a single zone game, each player starts at the first sequential indicator and attempts to get the ball through the hoop. Once each player has shot the ball from the first indicator, the sequence is followed from the remaining indicators, following the predetermined sequence. Points are received for each successful basket.

To play the multi-zone game, a first player starts at the first zone, standing on the first differential sequential indicator, attempting to shoot the ball around, or over, the obstacle and into the basket. The next player then proceeds to shoot the basket from the first indicator. The players continue to alternate shooting as they progress from indicator to indicator and zone to zone. Although one player can continue shooting until each indicator within the zone is completed, the alternating makes the game move faster as no one is a spectator for any length of time.

Other modifications and changes vary to fit particular operating requirements and environments which will be apparent to those skilled in the art. The instant invention is not considered limited to the example chosen for the purposes of disclosure, and covers all changes and modifications which do not constitute departures from the true spirit and scope of this invention.

What is claimed is:

1. The method of playing a recreational basketball game having:

multiple courts, each of said multiple courts having at least one hoop and backboard combination, multiple shooting indicators, each of said multiple shooting indicators being different than the other indicators within said court, obstacles, said obstacles obstructing clear entry of a ball into said hoop, at least one player, comprising the steps of:

a. providing a first of said at least one player with a set of game rules, said rules providing the order of proceeding through said multiple courts and the order of proceeding through said multiple shooting indicators within each of said multiple courts, b. a first of said at least one player proceeding to a first of said multiple courts, c. standing proximate a first of said multiple indicators, d. shooting a ball to said hoop, e. scoring a number of points for placing said ball through said hoop, f. said first of said at least one player proceeding to the next of said multiple indicators, g. said first of said at least one player completing each of said multiple indicators in said first of said multiple courts h. said first of said at least one player moving to a first of said multiple indicators in a next court, wherein each of said players proceeds to each of said multiple indicators within each of said multiple courts, repeating steps c–h, until each of said at least one player has completed each of said multiple courts.

2. The method of playing a recreational basketball game of claim 1 wherein the number of points awarded for shooting said ball through said hoop are different dependent upon said indicator.

3. The method of claim 1 wherein each of said at least one player proceeds immediately after a proceeding player, said players standing on said multiple indicators within a court alternating shooting said ball at said basket, thereby placing more than one player at a time within a court and enabling each of said at least one player to advance through said multiple shooting indicators and said multiple courts sequentially.

4. The method of claim 1 wherein a first of said at least one player completes shooting said ball through said hoop from each of said multiple indicators within a first court and proceeds to a next court and a next of said at least one player starts shooting said ball through said hoop from each of said multiple indicators within said first court, thereby placing only one player at a time within a court.

* * * * *